United States Patent [19]

Friedman et al.

[11] Patent Number: 4,929,936

[45] Date of Patent: May 29, 1990

[54] LED ILLUMINATED SIGN

[75] Inventors: Don Friedman; Thomas T. Chang, both of Las Vegas, Nev.

[73] Assignee: Home Security Systems, Inc., Las Vegas, Nev.

[21] Appl. No.: 170,949

[22] Filed: Mar. 21, 1988

[51] Int. Cl.[5] ..... G09G 1/16

[52] U.S. Cl. ..... 340/715; 340/762; 340/815.1; 340/815.03; 40/450

[58] Field of Search ..... 340/715, 815.1, 815.03, 340/760, 762, 815.32; 40/450, 451

[56] References Cited

U.S. PATENT DOCUMENTS

| | | | |
|---|---|---|---|
| 3,873,979 | 3/1975 | Craford et al. | 340/815.03 |
| 4,271,408 | 6/1981 | Teshima et al. | 340/815.1 |
| 4,298,869 | 11/1981 | Okumo | 340/815.03 |
| 4,488,149 | 12/1984 | Givens, Jr. | 340/762 |
| 4,587,753 | 5/1986 | Harper | 340/715 |
| 4,734,619 | 3/1988 | Havel | 340/762 |
| 4,751,506 | 6/1988 | Brown | 340/762 |
| 4,785,291 | 11/1988 | Hawthorne | 340/815.03 |

FOREIGN PATENT DOCUMENTS

| | | | |
|---|---|---|---|
| 0107373 | 6/1985 | Japan | 340/762 |

*Primary Examiner*—David K. Moore
*Assistant Examiner*—Mahmoud Fatahiyar
*Attorney, Agent, or Firm*—Quirk, Tratos & Roethel

[57] ABSTRACT

A lighted sign, particularly useful for identifying a residence number on a street, has a display panel having a plurality of aligned numbers illuminated by LED's which are selectively programmable by the user to display the proper house number. In the event of an emergency, the sign is changeable to an emergency mode in which the numbers flash intermittently, and the LED's change from a first color to a red color indicating the emergency. The sign is activated manually or by means of a photocell, and the emergency condition may be actuated by a manual switch for a remote transmitter. The device may also be used to activate other emergency alert signals, such as an audible signal or a signal transmitter over phone lines.

10 Claims, 4 Drawing Sheets

| SEGMENT / NUMBER | 14 | 24 | 22 | 20 | 18 | 16 | 26 |
|---|---|---|---|---|---|---|---|
| 0 | 0 | 0 | 0 | 0 | 0 | 0 | 1 |
| 1 | 1 | 0 | 0 | 1 | 1 | 1 | 1 |
| 2 | 0 | 0 | 1 | 0 | 0 | 1 | 0 |
| 3 | 0 | 0 | 0 | 0 | 1 | 1 | 0 |
| 4 | 1 | 0 | 0 | 1 | 1 | 0 | 0 |
| 5 | 0 | 1 | 0 | 0 | 1 | 0 | 0 |
| 6 | 0 | 1 | 0 | 0 | 0 | 0 | 0 |
| 7 | 0 | 0 | 0 | 1 | 1 | 1 | 1 |
| 8 | 0 | 0 | 0 | 0 | 0 | 0 | 0 |
| 9 | 0 | 0 | 0 | 0 | 1 | 0 | 0 |

LED ILLUMINATED SIGN

BACKGROUND OF THE INVENTION

This invention relates to an illuminated sign having selected indicia lighted by means of a plurality of LED's which may be conventional encapsulated LED's or LED dices. In particular, the invention relates to a sign having LED's which provide a single colored informational message in a normal state, and a red color flashing message in an emergency state.

Lighted signs bearing certain indicia, such as numbers or letters, are well known and used for a variety of purposes. Lighted signs which may indicate the house number of a residence, and which may be also used in case of emergency, are disclosed in Lazar, U.S. Pat. No. 3,360,791, Clardy, U.S. Pat. No. 3,599,201, and Browand, U.S. Pat. No. 4,003,040. Indicia on the face of these signs indicate the street number of the residence, and an emergency signal including a flashing red light is also provided to alert passersby of an emergency situation. Klingenberg, U.S. Pat. No. 3,913,092, discloses an alert sign mountable in a window having a HELP message illuminated by a flashing incandescent bulb. This type of warning device is useful for informing persons outside of a house of the plight of an ill person in the house. It is also known to use LED's in lighted signs; for example, Okuno, U.S. Pat. No. 4,298,869, discloses road signs and traffic lights using LED's.

Lighted signs bearing variable indicia, such as numbers or letters, may be useful for many purposes, including the indication of street numbers of residences, message signs in care centers, hospitals, restaurants, or any other enclosed environment which requires transmission of an illuminated message. The present invention contemplates a multi-purpose lighted sign which consists of a plurality of rows of lighted LED's which are selectively illuminated to form desired indicia. The display is preferably a conventional seven-segment, block figure "8", in which the segments can be illuminated to depict any number from 0–9. The sign is formed from a plurality of light display modules, thus enabling the sign to display a multi-digit number. If desired, the sign may be configured to show letters instead of, or in addition to, numbers.

The indicia are illuminated by straight rows of a plurality of low-voltage light-emitting diodes (LED's) which can be preset to send a desired message or display a specific number. Thus, a homeowner would set the proper switches upon purchase of the unit to display the correct house number permanently. Optionally, the sign may be linked to a number of useful features, such as a remote radio actuator and a photocell to turn the sign on when the light intensity decreases below a preset level. A particularly important feature of the invention is for the lighted portion of the sign to change from one color to a different color (e.g., from green to red) in an emergency situation. By using existing LED technology which enables the same LED to illuminate in different colors with different applied voltages, the sign can read in either an emergency or normal mode without losing any brightness. This is very important for LED's, which individually have a relatively low power level. A flashing mechanism in the sign circuitry enables the LED's to flash intermittently when the sign is in the emergency mode. In addition, actuation of the emergency mode may also activate any of a number of alarm systems, including an audible alarm such as a bell or whistle, or transmission of an alert signal off the premises (e.g., by telephone line) to a guard gate, police department, fire department, hospital, or the like. The emergency switch may be actuated either manually, remotely by a radio transmitter, or by some other automatic mechanism such as a smoke detector.

The use of LED's to illuminate the sign of the invention is advantageous since they require only a low-voltage (5–10 v) DC power source. Installation is very safe and does not require ducting as is required by most construction codes. In addition, the low voltage LED's have a much longer life expectancy than neon or incandescent illuminating devices. Power consumption is very low, yet light intensity is sufficiently high to enable the sign to be seen from a distance of up to 250 feet away (depending on ambient lighting conditions). Furthermore, maintenance and operating costs are very reasonable compared with other lighted signs. Accordingly, it is an object of the present invention to provide a lighted sign illuminated with LED's which is visible to a distance of several hundred feet, yet which uses a low voltage power source and is inexpensive and safe to operate. It is yet another object of the invention to provide a lighted sign which can change color from green to red in an emergency situation without losing visibility. It is yet a further object of the invention to provide an LED-illuminated sign which can be remotely actuated, and which itself can actuate remotely receivable alarm systems in an emergency situation. These and other objects are accomplished by the illuminated sign of the invention, a specific embodiment of which is described herein.

BRIEF SUMMARY OF THE INVENTION

An illuminated wall-mountable sign includes an enclosure having a plurality of display members mounted therein, each display member having an indicia display panel with a plurality of discrete display segments selectively illuminable to form lighted indicia. Each display segment comprises a linear row of a plurality of LED's capable of emitting light of at least two distinguishable colors. Electronic circuitry in the sign comprises a low voltage DC power source, a photocell to actuate the sign at times of low ambient illumination, switch means for actuating an emergency mode including a color change of the LED's, and a set of switches for selectively connecting each display segment of the display panels to the power source.

BRIEF DESCRIPTION OF THE DRAWINGS

The invention is best understood with reference to the drawings, in which.

DETAILED DESCRIPTION OF A PREFERRED EMBODIMENT

Figure 1:
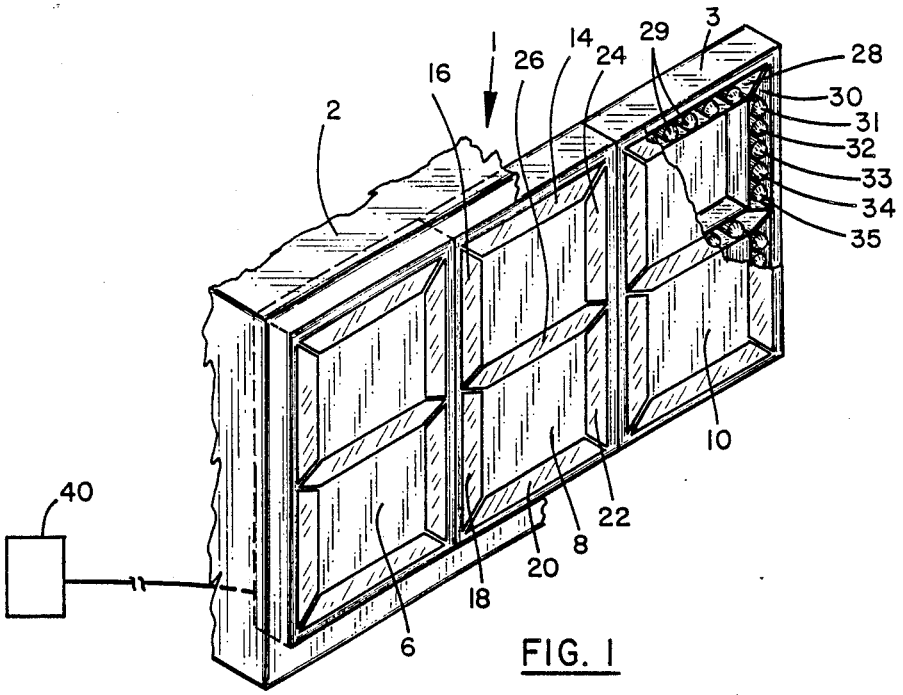
FIG. 1 is a perspective view, partially cut away, of a three-digit lighted sign of the invention.

Referring first to FIG. 1, the LED-illuminated sign 1 of the invention has an enclosure or mounting bracket 2 which encloses three identical display panels 6, 8, and 10. The display panels are mounted in side-by-side linear fashion, and as many display panels as may be necessary for the particular use for the sign may be used. Generally, at least two panels are used, and for most uses not more than six panels are necessary. The enclosure is simply a bracket which holds the display panels in place, and any type of enclosure may be used for this purpose. The enclosure also houses an electrical cord for attachment to a conventional 110-volt AC adapter 4 which converts 110 v AC power to low-voltage (e.g., 10 v) DC power. While these signs are particularly useful for residences, they can be easily adapted for other uses, such as road signs.

Each display panel member has a rectangular housing 3 having a flat front surface bearing a seven-segment display. For example, display panel member 8 has an opaque face 12 having a plurality of discrete transparent or translucent strips 14, 16, 18, 20, 22, 24, and 26 disposed in the geometry of a block figure "8". Each of the seven segments is separately illuminable as desired to form any of the numbers 0–9. This configuration is not novel, and is commonly used on clocks such as wristwatches and athletic scoreboards. The seven-segment display generally consists of a rectangle having vertical sides approximately twice the length of the horizontal ends, with a horizontal dividing line midway between the ends. Other configurations of letters may be used, but the LED's are preferably arranged in linear (though not necessarily straight) fashion. A plurality of low voltage, light-emitting diodes (LED's) are mounted in linear rows behind the light-transparent covering of the display segments. The LED's are mounted in molded channels in the housing, and are attached to a conventional PC board (not shown). As seen in FIG. 1, in display panel member 10, LED's 31, 32, 33, 34, and 35 are mounted in a channel 30 in the housing and form one segment of the seven-segment display. Similar LED's 29 are mounted in the upper horizontal segment of the display in channel 28. While each segment is shown as being of approximately equal length, and as having five LED's, different dimensions and a larger or smaller number of LED's can be used according to the configuration and size of the sign. In addition to a seven-segment figure "8"display, a display of different shape may be used to provide letters in addition to, or instead of, numbers.

The signs of the invention may be illuminated with any low-voltage light-emitting means, preferably light-emitting diodes (LED's). Conventional epoxy-encapsulated LED's may be used, although the use of LED dices is preferred since they are more cost-effective and are amenable to a simpler manufacturing process. LED dices are manufactured by Sharp of Japan, and are microscopic diode chips (approximately 5 mil. diameter) which are mounted on a circuit board by a bonding machine, As used herein, the term "LED" refers to all light-emitting diodes, including encapsulated LED's and LED dices. Typical two-color LED's which are commercially available are part No. MSGB51W. These are bipolar LED's which change color upon reversal of polarity, usually from red to green. LED dices perform in the same manner, but are manufactured by superimposing green and red dices on top of each other on a circuit board with polarities reversed. It is also possible to have two rows of independently wired red and green LED's in each sign segment. Part numbers for the red and green LED's are MSB51W and MGB51W, respectively.

Figure 2:
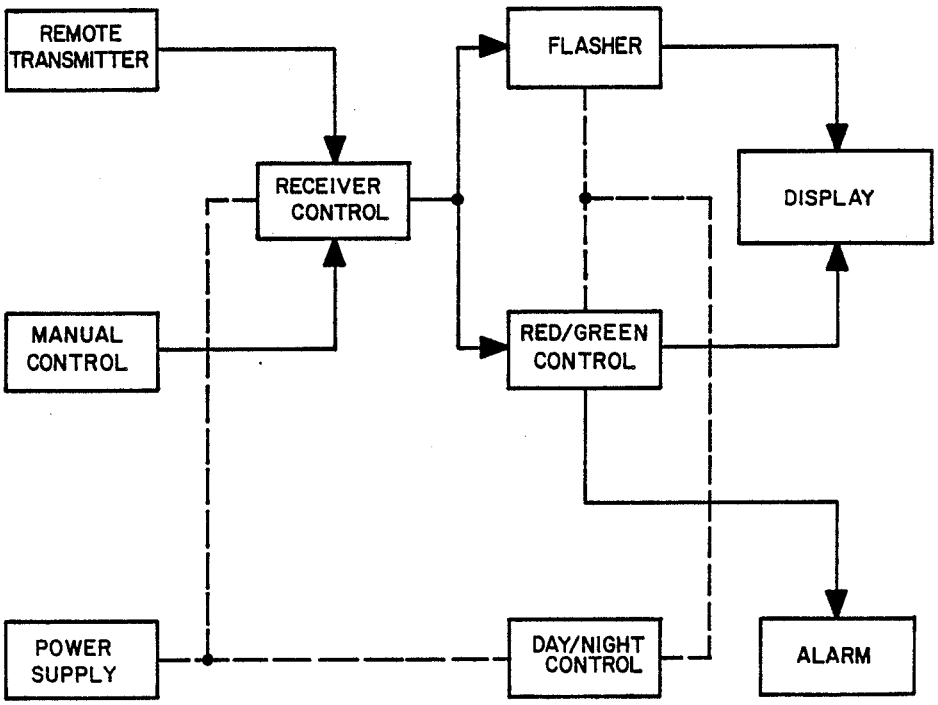
FIG. 2 is a block schematic diagram of the circuitry of the sign.
Figure 3:
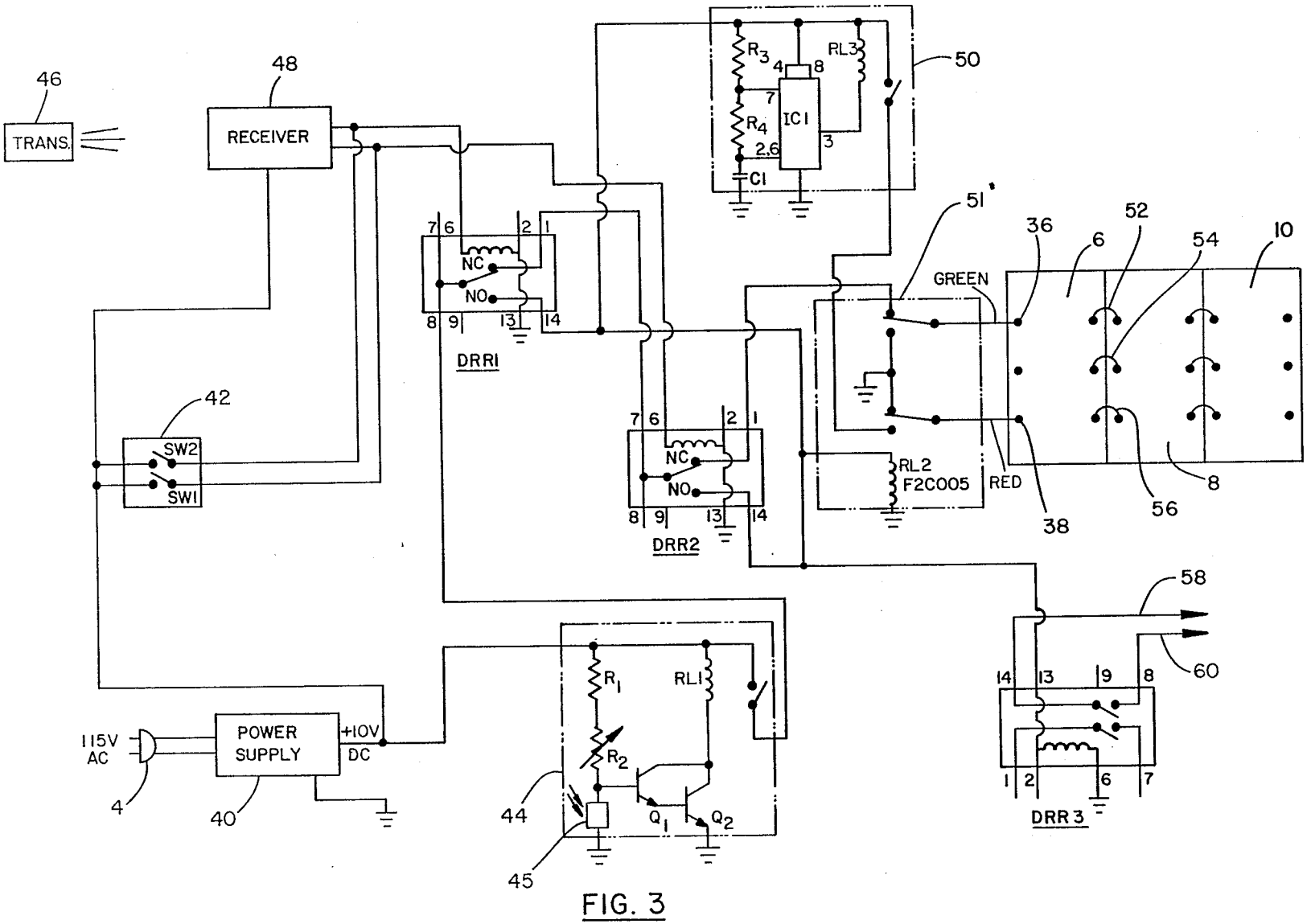
FIG. 3 is a detailed circuit diagram of the sign.

The basic circuitry for the illuminated sign of the invention is shown in FIGS. 2 and 3. FIG. 2 shows a block diagram of the electronic components of the invention. Referring to FIG. 2, power is supplied to the sign through a conventional power supply which provides a 10 volt DC power source. Actuation of the illumination of the sign may be effected either by a manual switch, or by means of a day/night control o photocell which turns the sign on when the ambient illumination decreases below a predetermined level. Actuation may also be effected by means of a simple radio receiver ("Receiver Control") which may be remotely actuated by means of a digitally encoded signal from a remote transmitter. Both the manual control and remote transmitter also have separate switches to actuate the emergency condition of the lighted sign. When the emergency condition is actuated, the red/-green control operates to change the color of the display from green to red, and the flasher is activated. At the same time, any secondary alarms (such as audible alarms or telephonically transmitted signals) are also activated.

A more detailed description of the circuitry of the invention is shown in FIG. 3. Power is provided to the sign from a conventional 110 v AC source of household current through plug 4 which connects to power supply 40, Sylvania Model V18. Output from the power supply is 10 v DC. Power is supplied to the display panel members 6, 8, and 10 through two control units DRR1 and DRR2 which control the flasher, the alarm, and the red/green control. These units are DIP Reed Relays, which are Sylvania units F1C005. At dusk or when light darkens CdS sensor 45 drops its resistance which allows both $Q_1$ and $Q_2$ to conduct through the Reed Relay thereby applying power to the flasher and the red/green control relay 51 so that they are actuated only at night time, or at other periods of low ambient lighting.

In normal operation, in which a homeowner wishes to actuate the house number on the sign in the normal green mode, and as night time approaches, the CdS sensor 45 in circuit photocell 44 reduces its resistance, enabling 10 v DC to be applied through RL1 to pin 8 on DRR1, also allowing voltage to be applied to pin 1 through the normally closed relay contact. Similarly, voltage is thus applied to pin 7 and pin 1 on DRR2, which is in the configuration shown in FIG. 3. Accordingly, the green light connection on the display unit is actuated, with the voltage passing to all of the display panel members 6, 8, and 10 through a series of simple jumper wires 52, 54 and 56 which connect the circuit boards of the three like display panel members as shown in FIG. 3. In this configuration, point 36 of the display panel is positive, while point 38 is connected to ground. In photocell circuit 44, $R_1$ and $R_2$ are 10K and 500K ohms, respectively, and $Q_1$ and $Q_2$ are H945P and MP5/3706, respectively.

When an emergency situation arises, and the emergency mode of the sign is actuated either through the manual closing of SW1 on manual control 42, or through actuation of the emergency switch on the transmitter 46 which actuates remote receiver 48, voltage is supplied to pin 6 on DRR2, moving the relay switch to the normally open position and applying voltage to pin 14 and pin 13 on DRR3, and also to relay coil RL2, moving the red/green switch to the red position. Additionally, actuation of pin 14 of DRRZ actuates flasher 50. Thus, energizing switch SW2 results also in a flashing red sign. DRR3 is also a DIP Reed Relay, Sylvania Model F2A005. As the relay coil on DRR3 is energized by current passing through the coil to grounded pin 6, both relay switches are closed connecting pins 14 and 8 and pins 1 and 7 to actuate an auxiliary alarm systems connected to the illuminated sign. This will automatically activate a telephone dialing mechanism or burglar alarm system which may emit an audible sound or a remotely receivable signal at a central station.

Actuation of the emergency flasher 50 occurs when SW2 is closed manually, or when a corresponding switch is actuated on the remote transmitter, thus activating the flasher circuit on the receiver. This provides voltage to pin 6 of DRR1, actuating the relay coil and pulling the switch to the normally open position, connecting pins 8 and 14. This puts the flasher circuit 50 into operation, and also energizes relay $RL_2$ pulling both sections of contacts of 1C1 (IC555) and relay $RL_3$. The flashing rate is determined by resistors and 1 capacitor. When $RL_2$ energizes and both sections of the contacts are pulled to the normally open position, the polarity of voltage applied to the display panels changes, resulting is red illumination. Since the positive voltage applied to point 38 is flashing at a rate of 1 to 2 cycles per second, thereby the red illumination flashes at the same rate. Typical values for $R_3$, $R_4$, and $C_1$ are 120K ohms, 470K ohms, and 4.7 $\mu$f, respectively.

While any type of remote transmitter and receiver may be used, Sylvania Model R1001T transmitter and Model R1001R receiver are simple, inexpensive, and compact units which are well adaptable to the illuminated sign of the invention.

Figures 4, 5:
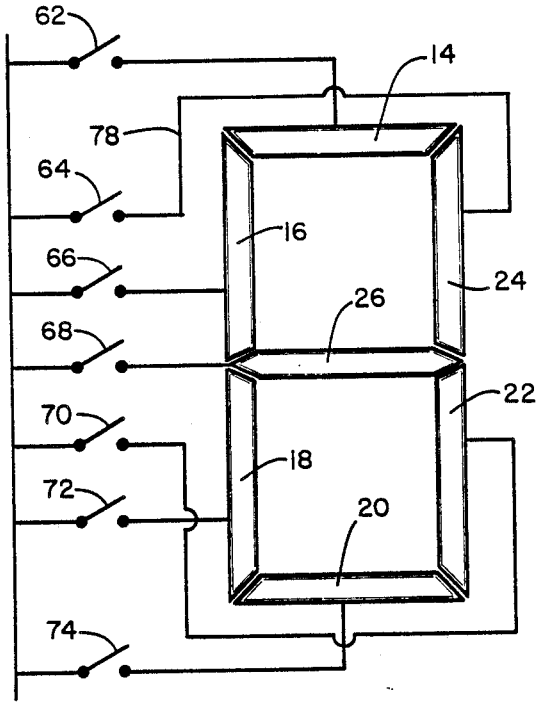
FIG. 4 is a schematic diagram of the switching mechanism for selecting a particular numeral to be illuminated.
FIG. 5 is a chart showing the mechanism for selecting the particular switch combinations shown in FIG. 4 to illuminate any given number.

FIGS. 4 and 5 illustrate the mechanism by which a homeowner can quickly and easily set the sign to display the correct house number. FIG. 4 illustrates diagramatically one of the seven-segment display panels with lines electrically connecting the power source through a series of switches to each of the segments. Each segment is separately connected through a series of switch means 62, 64, 66, 68, 70, 72, and 74, which control display panel segments 14, 24, 16, 26, 22, 18, and 20, respectively. Any type of simple on/off switch is contemplated, including a seven-position PC mounted miniature switch assembly which can be used to preclude illumination of a segment. FIG. 5 shows a table which will enable a user to set the switches 62–74 to display the desired number. In the table, the segments are numbered along the horizontal columns, while the number desired to be displayed is shown in the vertical column to the left. To use the table, a homeowner would simply pick the number desired to be displayed, and set the switches in the open or closed positions as set forth in the horizontal columns following the number, with the symbol "0" representing a closed switch and a symbol "1" indicating an open switch. For example, if the number "4" is desired to be displayed, the switches corresponding to segments 14, 20, and 18 would remain open, while the switches corresponding to segments 24, 22, 16, and 26 would be closed.

Figure 6:
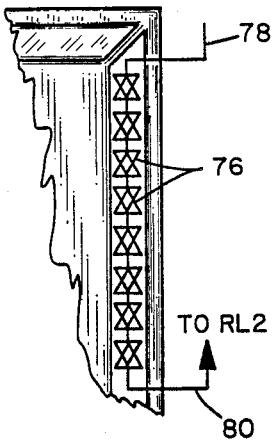
FIG. 6 is a partial wiring diagram showing the wiring of an indicia segment containing 8 LED's.

Each of the lines to the segments from the power source in actuality comprises two separate circuits, one for the green LED display and one for the red LED display. As shown in FIG. 6, each row of LED's comprising one of the segments (LED's 76 as shown in the drawing) are connected to the power source in series to RL2 and ground. Bipolar LED's 76 (which may be LED dices) are connected to red/green control switch 51 through line 78 and segment switch 64 (see FIG. 4) via the line identified as "GREEN" on FIG. 3. When the switch 51 is in the configuration shown in FIG. 3, DC current flows through line 78, LED's 76, line 80, and the "RED" line on FIG. 3 to ground. When RL2 is actuated by SW1, SW2 or the receiver, positive voltage changes from the "GREEN" to the "RED" terminal, with current flowing through the LED's in the opposite direction, causing emission of a red light.

While the invention has been described with respect to a specific embodiment thereof, many variations and adaptations thereof will be immediately obvious to those skilled in the art. For example, different types of mounting may be used, differing numbers and arrangements of display panels can be made, and a different configuration of the display panel is also possible. Accordingly, the invention should not be limited with respect to the specific embodiments previously disclosed, but rather should be defined only by the following claims.

I claim:

1. An illuminated sign comprises an enclosure, a plurality of display members mounted in the enclosure, each display member comprising a housing, an indicia display panel having a plurality of discrete display segments selectively illuminable to form lighted indicia, each display segment comprising an aligned row of a plurality of LED's, first electronic circuit means comprising a DC power source, the display segments, and first switch means actuated by a predetermined decrease in ambient lighting for connecting the power source to the display segments, and second electronic circuit means comprising the DC power source, means for changing the color of the display segments from a first color to a second color comprising a first linear array of LED dices connected in series in each display segment, a second linear array of LED dices connected in series in each display segment, and third switch means for selectively actuating the first or second arrays in each display segment, second switch means for connecting the power source to the display segments, receiver means for receiving a remotely generated signal, receiver switch means responsive to the reception of such signal for connecting the DC power source to the display segments, and manual switch means connected to the power source in parallel with the receiver switch means, flasher means for intermittently connecting the DC power source to the display segments, and a plurality of display segment actuating switches, one for each disply segment, adapted to be manually actuated for selectively disconnecting each display segment from the DC power source such that when the power source is connected to the display members, each indicia display panel displays a preselected indicia.

2. The sign of claim 1 also comprising alarm switch means for actuating alert means.

3. The sign of claim 1 also comprising alarm switch means for actuating alert means, said alarm switch means being actuated by the receiver switch means.

4. The sign of claim 1 wherein each display panel has seven linear display segments disposed in the geometry of a block figure "8".

5. The sign of claim 1 wherein each linear display segment includes a plurality of bipolar LED's.

6. An illuminated sign comprises an enclosure, a plurality of display members mounted in the enclosure, each display member comprising a housing, an indicia display panel having a plurality of discrete display segments selectively illuminable to form lighted indicia, each display segment comprising an aligned row of a plurality of bipolar two-color LED's, first electronic circuit means comprising a DC power source, the display segments, a plurality of display segment actuating switches adapted to be manually operated for selectively disconnecting each display segment from the DC power source such that when the power source is connected to the display members, each indicia display panel displays a preselected indicia, switch means actuated by a predetermined increase in ambient lighting for connecting the power source to the display segments, second electronic circuit means comprising the DC power source, flasher means for intermittently connecting the DC power source to the display segments, receiver means for receiving a remotely generated signal and receiver switch means responsive to the reception of such signal connecting the DC power source to the display segments, a manual switch means connected to the power source and parallel with the receiver switch means, alarm switch means actuated by the remotely generated signal, means for changing the color of each display segment from a first color to a second color comprising a first row of LED dices emitting light of a first color connected in series in each display segment, a second row of LED dices capable of emitting light of a second color connected in series in each display segment, and switch means for selectively actuating said first or second row of LED dices.

7. An illuminated sign comprises an enclosure, a plurality of display members mounted in the enclosure, each display member comprising a housing, an indicia display panel having a plurality of discrete display segments selectively illuminable to form lighted indicia, each display segment comprising an aligned row of a plurality of bipolar two-color LED's, electronic circuit means comprising a DC power source, the display segments, a plurality of display segment actuating switches adapted to be manually operated for selectively disconnecting each display segment from the DC power source such that when the power source is connected to the display members, each indicia display panel displays a preselected indicia, switch means actuated by a predetermined increase in ambient lighting for connecting the power source to the display segments, flasher means for intermittently connecting the DC power source to the display segments, alarm switch means for actuating a remote alarm, and polarity switch means for reversing the polarity of voltage across the display segments, said polarity switch means being movable from a first color position to a "red" position, said electronic circuit means including first switch means to connect the DC power source to the flasher means and the display segments, to move the polarity switch means to the "red" position, and to activate the alarm switch means, said electronic circuit means also comprising second switch means to connect the DC power source to the flasher means, the polarity switch means, and the display segments.

8. The sign of claim 7 in which the first switch means comprises receiver means for receiving a remotely generated signal.

9. The sign of claim 8 in which the first switch means also comprises first manual switch means connected in parallel with the receiver means.

10. The sign of claim 7 in which the first and second switch means comprises receiver means for receiving a remotely generated signal.

* * * * *